US007506398B2

(12) United States Patent
Martin

(10) Patent No.: US 7,506,398 B2
(45) Date of Patent: Mar. 24, 2009

(54) ADJUSTABLE TROWEL

(76) Inventor: John Martin, 963 Turtle Crest Dr., Irvine, CA (US) 92603

( * ) Notice: Subject to any disclaimer, the term of this patent is extended or adjusted under 35 U.S.C. 154(b) by 138 days.

(21) Appl. No.: 11/530,669

(22) Filed: Sep. 11, 2006

(65) Prior Publication Data

US 2008/0060159 A1 Mar. 13, 2008

(51) Int. Cl.
*E04F 21/16* (2006.01)

(52) U.S. Cl. ..... 15/235.8; 15/144.1; 15/235.6

(58) Field of Classification Search ..... 15/144.1, 15/235.4–235.8, 245.1
See application file for complete search history.

(56) References Cited

U.S. PATENT DOCUMENTS

| | | | | |
|---|---|---|---|---|
| 2,076,836 | A | 4/1937 | Goldblatt | |
| 3,045,271 | A * | 7/1962 | Cinotti | 15/235.8 |
| 3,916,472 | A | 11/1975 | Carder | |
| 4,254,980 | A | 3/1981 | Anderson | |
| D300,506 | S | 4/1989 | Pedone | |
| 5,440,784 | A | 8/1995 | Hull et al. | |
| D376,522 | S | 12/1996 | Tena | |
| 5,829,099 | A | 11/1998 | Kopelman et al. | |
| D403,035 | S | 12/1998 | MacPherson | |
| 6,247,204 | B1 | 6/2001 | Hamby et al. | |
| D459,645 | S | 7/2002 | Rothfus et al. | |
| D472,787 | S | 4/2003 | Kyte | |
| 2003/0070246 | A1 | 4/2003 | Cavalheiro | |
| 2004/0025897 | A1 | 2/2004 | Menaged et al. | |
| 2007/0163067 | A1 * | 7/2007 | Huang | 15/235.8 |
| 2007/0192982 | A1 * | 8/2007 | Ho | 15/235.8 |

FOREIGN PATENT DOCUMENTS

| | | | |
|---|---|---|---|
| DE | 20319714 | U1 * | 6/2004 |
| DE | 202006006590 | U1 * | 8/2006 |

* cited by examiner

*Primary Examiner*—Mark Spisich
(74) *Attorney, Agent, or Firm*—Kelly Lowry & Kelley LLP

(57) ABSTRACT

An adjustable trowel for spreading material on a surface includes a trowel plane and a post extending from the trowel plane. A mechanism for selectively attaches a handle to the post in either a left-handed orientation or a right-handed orientation relative to the trowel plane.

9 Claims, 5 Drawing Sheets

ADJUSTABLE TROWEL

BACKGROUND OF THE INVENTION

The present invention relates to trowels for spreading material on a surface. More particularly, the present invention relates to a trowel having a handle adjustable to a left-handed orientation or a right-handed orientation.

It is well-known by contractors, builders, construction workers, and do-it-yourself-ers that, prior to installing many types of floor and wall coverings, such as tile, carpet, etc., it is necessary to prepare the surface to be covered by spreading glue, plaster or the like evenly over the surface. In the past, this has been accomplished by using hand tools, such as trowels, for finishing concrete, plaster or the like. Conventional trowels are typically constructed of a flat metal plate blade having a toothed edge and a handle extended above and parallel to the plate by a support welded to the plate. The handles of these conventional trowels have been constructed of solid wood, plastic or the like and attached to the plate blade.

However, trowels such as those described above, have certain disadvantages. For example, the use of such trowels can result in blisters being formed on the surface of a user's hand. This can result in the user experiencing pain that impedes their ability to perform the tasks they need to accomplish. These blisters are caused by the conventional handle being designed to be gripped in the same manner by every user, regardless of whether the user is left-handed or right-handed.

Various attempts have been made to overcome the problems associated with conventional trowels. For example, U.S. Pat. No. 3,916,472 discloses a trowel for applying adhesives. However, while the trowel provided a reversible handle that would increase the usable life of the blade, the orientation of the handle is still indifferent to the handedness of the user. In another example, U.S. Pat. No. 4,254,980 discloses a trowel designed to prevent blisters from forming on the user's palms. However, the orientation of the handle is still indifferent to the handedness of the user. In a further example, U.S. Pat. No. 6,247,204 discloses a handle for a trowel and related tools. However, while the handle is designed to increase the user's control of the trowel, the orientation of the handle is still indifferent to the handedness of the user. The importance of a user being able to control the trowel in order to spread material evenly over a surface in a smooth manner is well-known but a tool that fails to take a user's left or right-handedness into account fails to recognize this important aspect of control.

Accordingly, there is a need for a trowel which conforms to a user's left or right-handedness. There is an additional need for a trowel having a handle that is easy and comfortable to hold. There is also a need for a trowel that allows the current user to be able to adjust the trowel to conform to that user's handedness. The present invention fulfills these needs and provides other related advantages.

SUMMARY OF THE INVENTION

The present invention resides in an apparatus that provides an adjustable trowel. As illustrated herein, an adjustable trowel for spreading material on a surface includes a trowel plane and a post extending from the trowel plane. A mechanism selectively attaches a handle to the post in either a left-handed orientation or a right-handed orientation relative to the trowel plane.

The trowel plane includes at least one toothed edge.

A first end of the handle defines a recess into which a portion of the post extends. The recess includes a keyway which defines a portion of the attaching means. The keyway comprises a plurality of key-receiving slots. The handle is disposed generally parallel to the trowel plane, and includes a grip.

The post includes a handle insert positionable within the recess. The handle insert includes a key for selectively engaging the recess.

The attaching mechanism includes a mechanism for locking the handle in a selected orientation. The locking mechanism includes a fastener which extends through the post to engage the handle.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
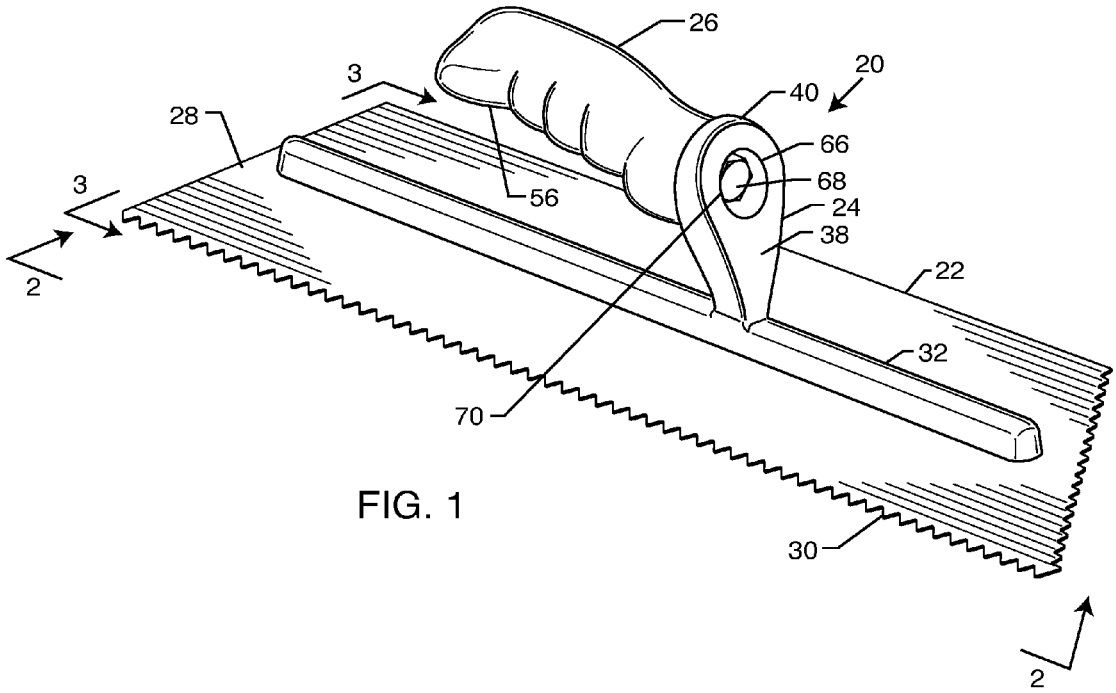
FIG. 1 is a perspective view of a trowel embodying the present invention, illustrating the trowel in a right-handed orientation.
Figure 2:
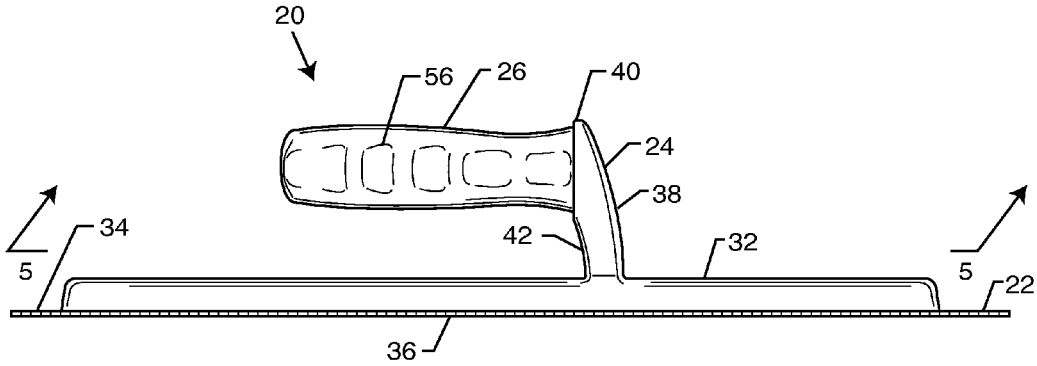
FIG. 2 is a side elevational view taken generally along the line 2-2 of FIG. 1.
Figure 3:
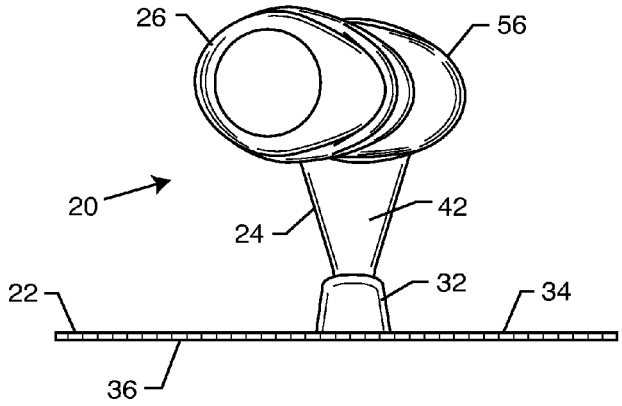
FIG. 3 is another side elevational taken generally along the line 3-3 of FIG. 1.
Figure 4:
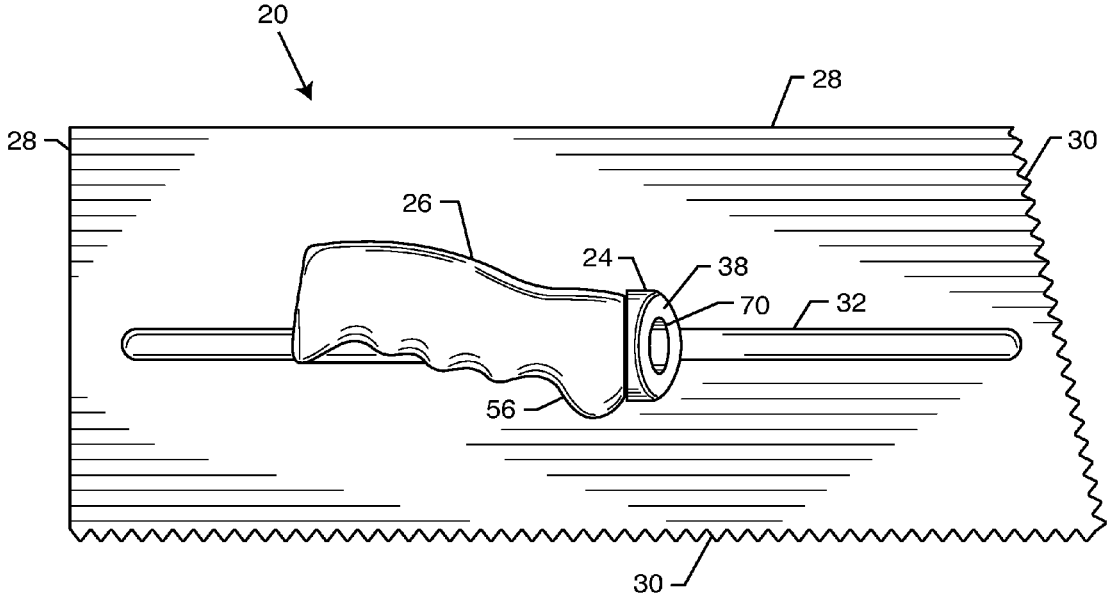
FIG. 4 is top plan view of the trowel of FIG. 1.
Figure 5:
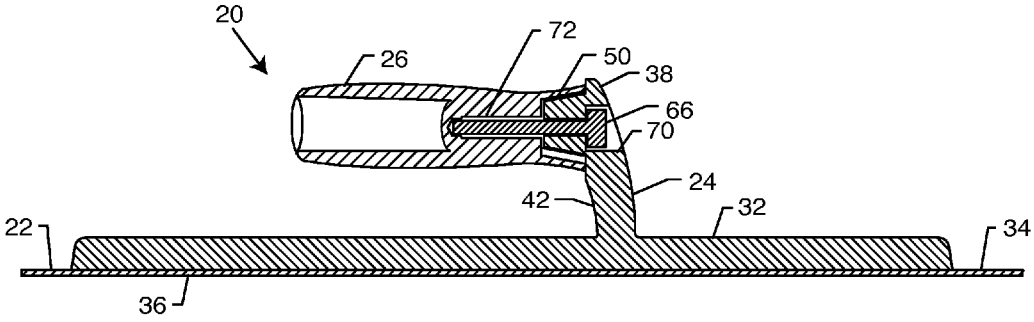
FIG. 5 is a cross-sectional view taken generally along the line 5-5 of FIG. 2.
Figure 6:
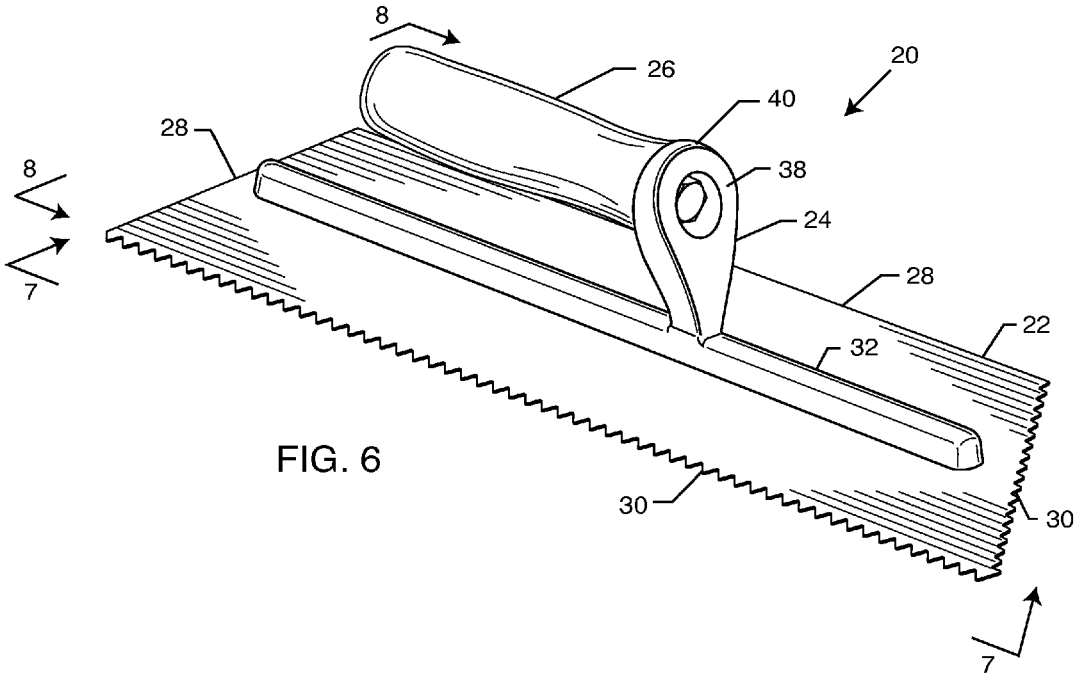
FIG. 6 is a perspective view of a trowel embodying the present invention illustrating the trowel in a left-handed orientation.
Figure 7:
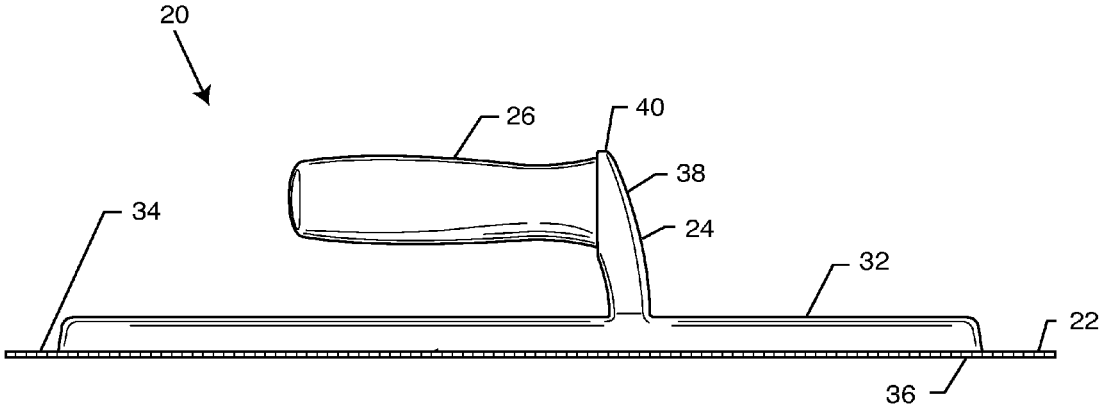
FIG. 7 is a side elevational view taken generally along the line 7-7 of FIG. 6.
Figure 8:
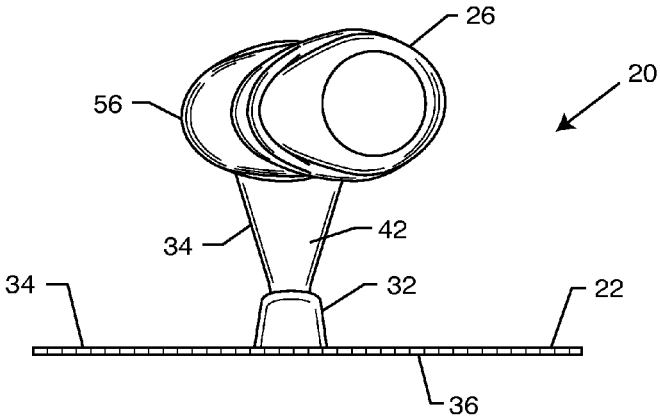
FIG. 8 is another side elevational taken generally along the line 8-8 of FIG. 6.
Figure 9:
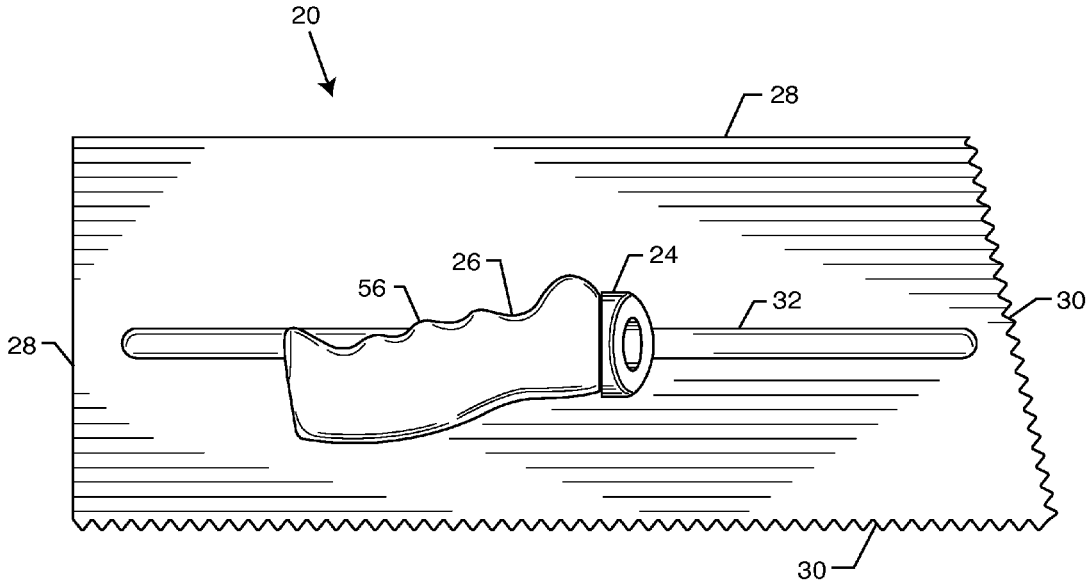
FIG. 9 is top plan view of the trowel of FIG. 6.

As shown in FIGS. 1-11 for purposes of illustration, the present invention is concerned with an adjustable trowel 20 for spreading material on a surface.

The trowel 20 includes a trowel plane 22, a post 24 extending from the trowel plane 22, and a handle 26.

The trowel plane 22 is in the form of a relatively flat metal plate or blade. The plane 22 can be constructed in various shapes (e.g., rectangular, triangular, ovoid, or the like) using various different types of materials (e.g., metals and plastics having a wide range of flexibility). The plane 22 includes a number of smooth edges 28. Alternatively, the plane 22 may include all smooth edges 28, all toothed edges 30 or a mixture of smooth edges 28 and toothed edges 30.

A mounting bar 32 is fixedly connected to an upper surface 34 of the plane 22 by welding or fasteners (e.g., screws, bolts, rivets or the like). The mounting bar 32 has a generally rectangular cross-section, extending longitudinally along a central portion of the plane 22. Although the mounting bar 32 is generally centered on the plane 22, the mounting bar 32 does not extend for the entire length of the plane 22. A lower surface 36 of the plane 22 is generally continuous and smooth.

The post 24 extends upwardly from the mounting bar 32. The post 24 is integral with the mounting bar 32, either being of single piece construction with the mounting bar 32 or mechanically connected thereto using various fasteners (e.g., screws, bolts, rivets or the like). The post 24 includes a generally tear-shaped front surface 38 that widens upwardly along the post 24. The post 24 includes an upper arcuate surface 40. A rear surface 42 of the post 24 has a similar shape to the front surface 38, but includes a handle insert 44, in the form of a truncated conical shank or tang, extending rearwardly away from the post 24. The handle insert 44 is integral with the post 24, either being of single piece construction with the post 24 or mechanically connected thereto using various fasteners (e.g., screws, bolts, rivets or the like). The handle insert 44 is positioned so as to be generally parallel to and extend along, but in spaced relationship with respect to the mounting bar 32. The handle insert 44 includes a mechanism 46 for selectively attaching the handle 26 to the post 24 in a generally left-handed orientation relative to the trowel plane 22 in order to accommodate a left-handed user or a generally right-handed orientation relative to the trowel plane 22 in order to accommodate a left-handed user.

Figure 10:
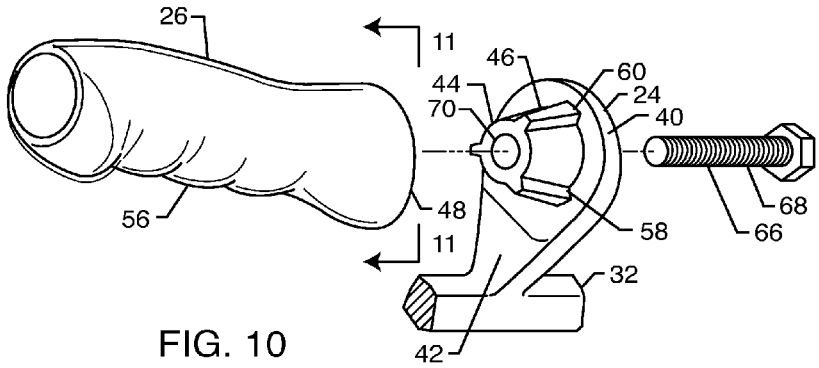
FIG. 10 is an exploded perspective view of a handle, post, and selectively attaching mechanism of the trowel of FIG. 1.
Figure 11:
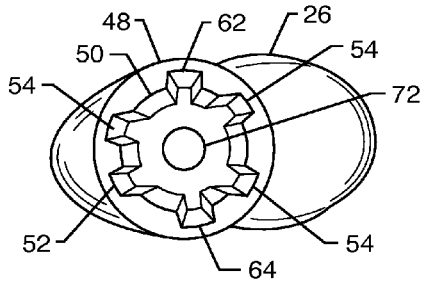
FIG. 11 is a side elevation view of the handle taken generally along the line 11-11 of FIG. 10.

A first end 48 of the handle 26 defines a recess 50 into which the handle insert 44 extends. The recess 50 is generally shaped in the form of a truncated cone and sized to engage the handle insert 44. The recess 50 includes a keyway 52 which defines a portion of the mechanism 46 for selectively attaching the handle 26 to the post 24. The keyway 52 comprises a plurality of key-receiving slots 54 disposed about the circumference of the recess 50. The handle 26 is disposed generally parallel to the trowel plane 22, and includes a grip 56. The handle insert 44 is positionable within the recess 50 and includes a key 58 which defines another portion of the mechanism 46 for selectively attaching the handle 26 to the post 24. The key 58 includes a number of elongated flanges 60 (e.g., three flanges 60 are illustrated in FIG. 10) arranged about the circumferential exterior of the handle insert 44, running generally longitudinally along the handle insert 44 away from the post 24. The slots 54 (e.g., six slots 54 are illustrated in FIG. 11) of the keyway 52 are comprised a first set 62 of left-hand orientation slots 54 and a second set 64 of right-hand orientation slots 54. Both sets 62, 64 of slots 54 are arranged about the circumference of the recess so that the flanges 60 of the key 58 are able to engage either the first set 62 of slots 54 to place the handle 26 in a generally left-handed orientation or the second set 64 of slots 54 to place the handle 26 in a generally right-handed orientation. When the handle 26 engages the handle insert 44, the handle 26 is not able to rotate relative to the post 24. The angular difference between the flanges 60 as arranged about the circumference of the handle insert 44 allows a user to adjust the flanges 60 to engage the slots 54 of either set 62, 64 so that the handle 26 engages the handle insert 44 of the post 24 in a left or right-handed orientation with the grip 56 generally parallel to the upper surface 34 of the trowel plane 22, slightly angled upwardly with respect to the upper surface 34 of the trowel plane 22, or slightly angled downwardly with respect to the upper surface 34 of the trowel plane 22.

The trowel 20 also includes a mechanism for locking 66 the handle 26 in a selected orientation. The locking mechanism 66 includes a threaded fastener (e.g., a bolt, screw or the like) 68 inserted through a bore 70 (threaded or smooth) extending through the post 24 and handle insert 44 into a threaded bore 72 positioned with an opening at one end of the recess 50 in order to removably secure the handle 26 to the post 24.

In the alternative, a trowel can include a left-handed handle insert (i.e., the flanges 60 of the key 58 are able to engage only the first set 62 of slots 54 to place the handle 26 in a generally left-handed orientation) and a right-handed handle insert (i.e., the flanges 60 of the key 58 are able to engage the second set 64 of slots 54 to place the handle 26 in a generally right-handed orientation) with the inserts disposed on opposite sides of the post 24. The use of dual handle inserts can allow both left-handed and right-handed users to use a trowel plane 22 having a toothed edge 30 along only a single longitudinal edge of the trowel plane 22. The post 24 would be centrally located along the length of the mounting bar 32. users to use a trowel plane 22 having a toothed edge 30 along only a single longitudinal edge of the trowel plane 22. The post 24 would be centrally located along the length of the mounting bar 32.

In another alternative, instead of a handle insert, a number of keys in the form of bars, cubes, cylinders, directly can extend away from the surface of the post. The handle could include a first set of recesses sized and shaped to receive the keys to place the handle in a generally left-handed orientation and a second set of recesses sized and shaped to receive the keys to place the handle in a generally right-handed orientation. The post would include a bore (threaded or smooth) extending through the post and the handle would include a threaded bore positioned with an opening at an end of the handle facing the post in order to removably secure the handle to the post by inserting a threaded fastener (e.g., a bolt, screw or the like) through the bores.

All features of the various embodiments discussed above can be mixed and matched to define an embodiment that is not directly illustrated in the accompanying figures.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. An adjustable trowel for spreading material on a surface, comprising:

a trowel plane;

a post extending from the trowel plane; and means for selectively attaching a handle to the post generally parallel to a longitudinal central portion of the trowel plane in either a left-handed orientation or a right-handed orientation relative to the trowel plane, wherein a first end of the handle defines a recess into which a portion of the post extends and the post includes a handle insert positionable within the recess, the recess including a keyway which defines a portion of the attaching means and comprises a plurality of key-receiving slots and the handle insert includes a key for selectively engaging one of the plurality of key receiving slots.

2. The adjustable trowel of claim 1, wherein the trowel plane includes at least one toothed edge.

3. The adjustable trowel of claim 1, wherein the handle is disposed generally parallel to the trowel plane, and includes a grip.

4. The adjustable trowel of claim 1, wherein the attaching means includes a means for locking the handle in a selected orientation.

5. The adjustable trowel of claim 4, wherein the locking means comprises a fastener which extends through the post to engage the handle.

6. An adjustable trowel for spreading material on a surface, comprising:

a trowel plane;

a post extending from the trowel plane;

means for selectively attaching a handle to the post generally parallel to a longitudinal central portion of the trowel plane in either a left-handed orientation or a right-handed orientation relative to the trowel plane, wherein a first end of the handle defines a recess into which a portion of the post extends and the post includes a handle insert positionable within the recess, the recess including a keyway which defines a portion of the attaching means and comprises a plurality of key-receiving slots and the handle insert includes a key for selectively engaging one of the plurality of key receiving slots; and means for locking the handle in a selected orientation.

7. The adjustable trowel of claim 6, wherein the trowel plane includes at least one toothed edge.

8. The adjustable trowel of claim 6, wherein the handle is disposed generally parallel to the trowel plane, and includes a grip.

9. The adjustable trowel of claim 6, wherein the locking means comprises a fastener which extends through the post to engage the handle.

* * * * *